United States Patent [19]

Weber

[11] 4,223,422

[45] Sep. 23, 1980

[54] TURNTABLE FOR DEPOSITING A FIBER SLIVER INTO A SPINNING CAN

[75] Inventor: Kurt Weber, Elgg, Switzerland

[73] Assignee: Rieter Deutschland GmbH, Stuttgart, Fed. Rep. of Germany

[21] Appl. No.: 532

[22] Filed: Jan. 2, 1979

[30] Foreign Application Priority Data

Jan. 11, 1978 [DE] Fed. Rep. of Germany ..... 2801010

[51] Int. Cl.[2] ..... B65H 54/80

[52] U.S. Cl. ..... 19/159 R; 242/82

[58] Field of Search ..... 19/159 R, 159 A; 28/289; 242/82

[56] References Cited

U.S. PATENT DOCUMENTS

| | | | |
|---|---|---|---|
| 4,041,574 | 8/1977 | Müller | 19/159 R |
| 4,074,394 | 2/1978 | Kunig et al. | 19/159 R |

FOREIGN PATENT DOCUMENTS

| | | | |
|---|---|---|---|
| 2444020 | 1/1976 | Fed. Rep. of Germany . | |
| 7529051 | 1/1976 | Fed. Rep. of Germany . | |
| 2323619 | 4/1977 | France . | |
| 316628 | 12/1971 | U.S.S.R. | 19/159 R |

*Primary Examiner*—Louis Rimrodt

*Attorney, Agent, or Firm*—Werner W. Kleeman

[57] ABSTRACT

A turntable for the deposition of a fiber sliver into a spinning can comprising a sliver duct and calender rolls arranged, viewed in the direction of material flow, after the sliver duct and circling or orbiting therewith. Each calender roll is provided with a rotational axis which is arranged substantially parallel to the rotational axis of the turntable. The rotational axes of the calender rolls and the rotational axis of the turntable can be arranged for instance at least substantially in one plane.

13 Claims, 5 Drawing Figures a
2
1
16
17
8
9
3
5d
B
b
c
4
B
C
C
19
13
5
11
15
12
10
14
3a 6
7

5
18a
18
22
d
21
f
15
8
19
A
A
11
10
12
3
20
6
7

TURNTABLE FOR DEPOSITING A FIBER SLIVER INTO A SPINNING CAN

BACKGROUND OF THE INVENTION

The present invention relates to a new and improved construction of a turntable for depositing a fiber sliver into a spinning can or canister and comprises a sliver duct and calender rolls arranged after and revolving with the sliver duct.

Turntables of this type are employed on various spinning machines which produce a fiber sliver. The fiber sliver, for the purpose of subsequently processing the same, must be deposited in orderly windings or coils in a spinning can or canister. In this arrangement the precision of the sliver deposition is of great importance, since only optimum sliver deposition insures that the sliver can be again removed properly from the sliver can and thus can be presented to the subsequent processing machine, and that the filling weight of the can, i.e., the sliver quantity which can be deposited in the can, can be chosen optimumly high. To insure this it is impermissible for uncontrolled drafts to occur, neither during sliver deposition into the can nor during the subsequent removal from the can.

Turntables of such type are known which permit positive removal of the fiber sliver from the sliver duct to the turntable exit with simultaneous compression or condensing of the sliver by the action of the calender rolls.

Thus, for instance, in German patent publication No. 2,444,020 and the corresponding U.S. Pat. No. 4,041,574 there is disclosed a turntable or coiling device for depositing fiber slivers into a spinning can wherein a sliver duct is followed by a pair of calender rolls which orbit with the sliver duct and, viewed in the direction of flow of the material, directly precedes a sliver exit opening arranged eccentrically in the turntable. The rotational axes of the rolls of the pair of calender rolls are arranged at right angles to the rotational axis of the turntable. Since such type turntables normally are arranged in a horizontal position above the spinning can they rotate about a vertical axis, and the axes of the calender rolls are arranged in a horizontal plane.

In German petty Pat. No. 7,529,051 and the corresponding French Pat. No. 2,323,619, there is disclosed an arrangement of a deflecting roll dispositioned parallel to the calender rolls which also rotate about axes which are horizontally arranged. With this construction there is intended to achieve easier threading-in of the sliver into the turntable and a more reliable guiding of the fiber sliver which passes therethrough at high speed in comparison to the above-mentioned solution utilizing only two calender rolls.

These known proposals employing horizontally arranged calender rolls are associated with various disadvantages. A first drawback resides in the fact that the fiber sliver emerges in vertical direction from the turntable. However, the fiber sliver is deposited winding upon winding in a horizontal plane, during which process the sliver is deflected at the exit of the turntable in tangential direction against the rotation of the turntable. This sharp 90° deflection during deposition results in undesirable damage to the fiber sliver at the very high sliver speeds coming under consideration, which amount to as much as 1000 meters per minute.

A further shortcoming of the state-of-the-art turntables is seen in that the precision of the sliver deposition is impaired by virtue of the fact that the nip of the calender rolls is always located at least at a distance equal to the radius of the depositing rolls above the lower limiting or boundary surface of the turntable. Since the diameters of these rolls should not be chosen to be too small, by taking into account the lap-up danger in accordance with the relation between the staple length of the fiber material being processed and the roll diameter, the guiding point for the fiber sliver is located several centimeters above the deposition plane. Consequently, the precision of the sliver deposition is placed in doubt. However, some relief can be attained if a guide funnel is provided following the calender rolls, for instance as taught in German patent publication No. 2,444,020. Yet, here the frictional problems caused by the 90° deflection of the fiber sliver in the guide funnel are so great that the utilization of such guide funnel becomes problematic.

Considered from the design standpoint these prior art turntables furthermore are afflicted with the considerable disadvantage that an angle or miter gear arrangement is needed for driving the calender rolls. The drive of the calender rolls is preferably derived from the rotational movement of the turntable. Yet, such gear arrangements are extremely problematic when operating at high speeds due to noise-generation, lubrication, maintenance work which is necessitated by wear and so forth.

Finally, the heretofore known turntables have the limitation that they require a relatively large elevational space due to the horizontal arrangement of the calender rolls and the corresponding drive mechanisms. As a result, the operation of the entire machine is negatively influenced due to the excessively large structural height, or otherwise there is required reduction of the maximum employed sliver can height.

SUMMARY OF THE INVENTION

Therefore, with the foregoing in mind it is a primary object of the present invention to provide a new and improved construction of a turntable for depositing a fiber sliver into a spinning can in a manner not associated with the aforementioned drawbacks and limitations of the prior art proposals.

Another and more specific object of the present invention aims at eliminating the above-mentioned disadvantages of the heretofore known turntables of this type and to devise a turntable for the deposition of a fiber sliver into a spinning can in a manner insuring for absolutely precisely located deposition of the sliver without any uncontrolled drafts, even at working speeds amounting to as much as 1000 meters per minute.

Yet a further object of the invention is to provide a turntable or coiling device of the character described which is structured so that it generates low vibrations and noise and is simple in design and easy to maintain and service.

A further important object of the invention is the provision of a turntable for deposition of fiber sliver into a spinning can in a highly efficient, reliable and accurate fashion.

Another important object of the invention aims at providing a turntable construction which creates optimum working conditions at the related spinning machine for the operators.

Now in order to implement these and still further objects of the invention, which will become more readily apparent as the description proceeds, the turntable or coiling device for the deposition of a fiber sliver into a spinning can as contemplated by the invention is manifested by the features that it is provided with a sliver duct and calender rolls which, viewed in the direction of flow of the material, are arranged after the sliver duct and circle or revolve with the sliver duct, and furthermore, each calender roll is dispositioned such that its rotational axis is arranged substantially parallel to the rotational axis of the turntable.

According to a first variant embodiment of the invention two calender rolls can be provided, the rotational axes of which are located at least approximately in one plane with the rotational axis of the turntable.

According to a further construction of the invention a deflecting or deflection roll, arranged parallel to the two calender rolls, is operatively associated with the calender rolls. The rotational axes of one of the calender rolls and the deflecting roll are arranged at substantially the same distance from the rotational axis of the turntable and the rotational axes of the calender rolls and the rotational axes of the turntable are arranged approximately at least in one plane.

Furthermore, the turntable can be rotatably supported in a support member provided with a belt pulley for a drive belt, and the calender rolls can be driven by a drive belt which partially trains about the belt drive pulley and at least one pulley of a calender roll. The belt is preferably a toothed belt.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
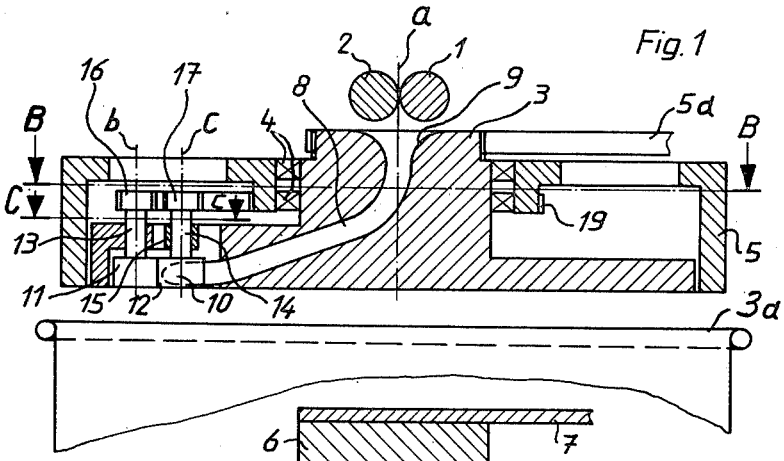
FIG. 1 is a sectional view of a first exemplary embodiment of turntable according to the invention, taken substantially along the line A—A of FIG. 2.

Describing now the drawings, in FIG. 1 there are illustrated infeed rolls 1 and 2 which deliver a fiber sliver (not shown) and constitute part of a spinning machine, further details of which are not here illustrated since they are unimportant for understanding the principles of the invention. A machine of such type can be, by way of example, a card, a draw-frame or combing machine for short staple or long staple fiber material, which is equipped with a sliver depositing device, also referred to in the art as a coiler or coiling device, for the deposition of the fiber sliver into sliver cans or canisters placed therebelow. One such sliver can or canister has been shown in FIG. 1 and designated by reference character 3*a*. The infeed or delivery rolls 1 and 2 deliver the fiber sliver at a high speed which may amount to as much as 1000 meters per minute. At the relevant operating speed the sliver must be deposited in orderly windings or coils into the sliver can 3*a*. Such coilers exist for stationary sliver cans and for rotating sliver cans. The turntable constructions of the invention are suitable for use both in the first case and in the second case, since its movements which are to be carried out are immaterial in the context of the present invention.

Continuing, a turntable 3 is rotatably supported on two antifriction bearings 4 in a support member or support means 5 in order to be rotatable about the rotational axis a. The support member 5 can be stationary with respect to the surroundings, in which case mounting element 6 can be provided on a frame part 7, as best seen by referring to FIG. 2, or can be itself rotatably supported in the not particularly shown machine frame.

A fiber sliver duct or channel 8 is provided in the turntable 3. Viewed in the direction of the material flow, i.e., the throughpassing direction of the fiber sliver, this fiber sliver duct 8 begins with a funnel 9 which at its upper side is arranged centrally with respect to the rotational axis a of the rotatable turntable 3 and constitutes an entry or inlet opening. Following the funnel 9 the fiber sliver duct 8 extends at an inclination towards the periphery of the turntable 3 towards the exit or discharge opening 10. As best seen by referring to the top plan view of FIG. 2, this fiber sliver duct 8 at its starting region extends substantially linearly, in radial direction and then forms a curve at the region near the exit or discharge opening 10, as will be discussed more fully hereinafter in conjunction with the enlarged view of FIG. 3.

The exit opening 10 is located at the immediate vicinity of a pair of calender rolls 11 and 12 which are arranged after the fiber sliver duct 8. The outer calender roll 11, which is arranged furthest from the rotational axis a of the turntable 3, in the arrangement under discussion, is rotatably supported in the turntable 3 in a rigidly mounted, standard antifriction bearing (not shown) and is rotatable about the lengthwise axis of its shaft 13 in a manner such that its rotational axis b extends substantially parallel to the rotational axis a of the turntable 3.

Since the rotational axis a usually extends vertically in space in most spinning machines, the calender roll 11 also rotates about a vertical axis. The second calender roll 12 also comprises a shaft 14 which, since the calender rolls 11 and 12 normally are cylindrical, extends essentially parallel to the shaft 13 of the calender roll 11, i.e., the rotational axis c of the calender roll 12 is substantially parallel to the rotational axis a of the turntable 3.

Small deviations from parallelity between the axes a, b and c, for instance owing to slight taper of the calender rolls 11 and 12, are to be considered as encompassed within the scope and teachings of the present invention. Also, it is to be understood that it would be conceivable to employ, instead of the cylindrical calender rolls 11 and 12, calender rolls having a slight complementary conical configuration while maintaining parallelism of their axes, should an arrangement of such type prove favorable for improving deposition of the fiber sliver or the like.

Since the outer calender roll 11 is stationarily supported at the turntable 3 the calender roll 12 is pressed against the calender roll 11 in order to generate the nip line. In this arrangement there is thus required a movable support of the calender roll 12 with respect to the turntable 3.

With the illustrated arrangement of the calender rolls 11 and 12 the rotational axes b and c are contained in a single plane together with the rotational axis a of the turntable 3. In this case the calender roll 12 is arranged to be radially movable with respect to the calender roll 11 against which it is pressed in radial direction.

With an arrangement of this type pressing of the inner calender roll 12 against the outer calender roll 11 can be achieved in a most simple manner in that calender roll 12 is pressed against calender roll 11 by the centrifugal force generated by rotation of the turntable 3.

Figure 2:
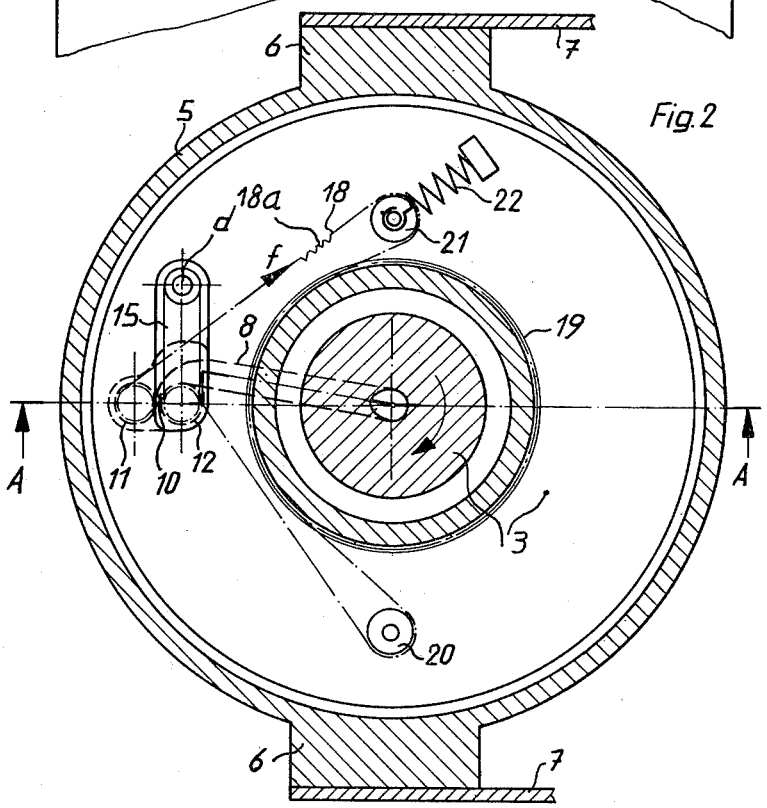
FIG. 2 is a sectional view of the turntable shown in FIG. 1, taken substantially along the line B—B of FIG. 1.

FIGS. 1 and 2 furthermore illustrate a preferred support arrangement of the calender roll 12. Here the calender roll 12 is shown supported in or at a lever 15. The lever 15 is arranged at the turntable 3 to be pivotable about a pivot axis d, as best seen by referring to FIG. 2, and this pivot axis is substantially parallel to the rotational axis a of the turntable 3.

The calender rolls 11 and 12, owing to their position relative to the rotational axis a of the turntable 3 as previously described, now can be driven without the need to use any angle or miter gear arrangement and from the support member 5 which has a relative speed with respect to the turntable 3. This turntable 3 is rotatably driven in the support member 5 by suitable drive means, for instance a toothed belt 5*a*. The shafts 13 and 14 of the calender rolls 11 and 12 are each provided at their ends opposite the calender rolls with a pulley 16 and 17, for a belt 18 or equivalent drive element, as best seen by referring to FIG. 2. A belt pulley 19 is arranged on the support member 5 concentrically with respect to the bearings 4 in the same plane where there are located the belt pulleys 16 and 17. Furthermore, a deflecting or deflection roll 20, stationarily supported with respect to the turntable 3, is arranged in the turntable 3 in the same plane containing the aforementioned belt pulleys 16, 17 and 19, and there is further provided in such plane a tensioning roll 21 for the belt 18. The tensioning roll 21 is guided in the turntable 3 by any suitable means and forms in conjunction with a tension spring 22 or equivalent structure which is fixed in the turntable 3 a tensioning unit or tensioning means for the belt 18. This belt 18 is trained around the belt pulleys 16, 17, 19, 20 and 21 in such a manner that during rotation of the turntable 3 the belt 18 rolls upon the belt pulley 19 of the support member 5 owing to the relative speed between the turntable 3 and the support member 5, and thus, moves in the direction of the arrow f with respect to the turntable 3, thereby driving the belt pulleys 16, 17, 20 and 21. By appropriately selecting the diameters of the belt pulleys 16, 17 and 19 there is insured that the circumferential speed of the calender rolls 11 and 12—except possibly for a small tensioning draft acting upon the fiber sliver—equals the circumferential speed of the rolls 1 and 2 in such manner that the fiber sliver is not subject to uncontrolled drafts in the fiber sliver duct 8, and also equals the throughput speed through the nip line between the calender rolls 11 and 12 as they rotate about the rotational axis a of the turntable 3.

The illustrated arrangement of the drive belt 18, where the belt 18 always remains outside the belt pulley 19, i.e., does not enclose it, on the one hand, is required for the purpose of insuring the correct direction of rotation of the calender rolls 11 and 12. On the other hand, this arrangement also affords the notable advantage that the belt 18 can be dismantled or exchanged without the need to disassemble the turntable 3 from the support 5.

The belt 18 is preferably designed as a slip-free toothed belt, as generally schematically indicated in FIG. 2 by reference character 18*a*. In such case the belt pulleys 16, 17 and 19 are correspondingly provided with a toothed construction, i.e., constitute toothed belt pulleys.

Figure 3:
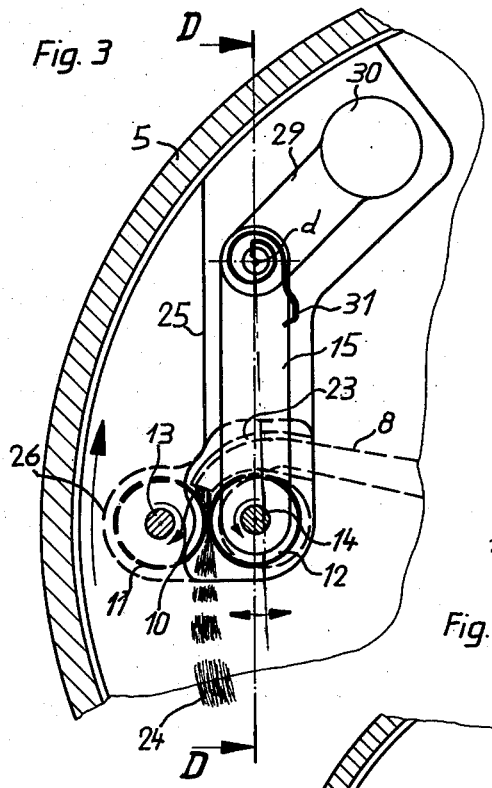
FIG. 3 is an enlarged detail showing of another embodiment of turntable.
Figure 4:
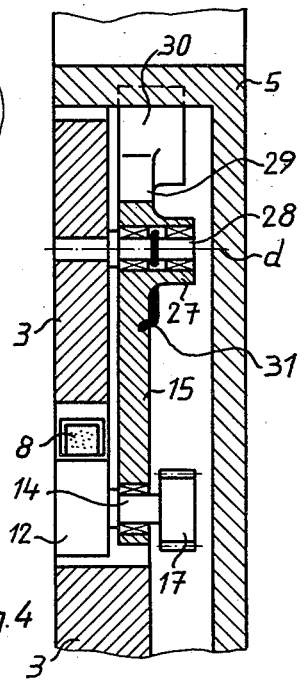
FIG. 4 is a sectional view of the turntable depicted in FIG. 3, taken substantially along the line D—D thereof.

From the showing of FIGS. 3 and 4 it will be clearly seen that the fiber sliver duct 8 at its outfeed or merging zone possesses a curvature 23 about the calender roll 12 in such a manner that its exit or discharge opening 10 reaches the converging zone between the calender rolls 11 and 12. Furthermore, with such shape of the fiber sliver duct 8 it can be advantageous if its side adjacent the cylindrical surface of the calender roll 12 is left without a wall, i.e., is open (see FIG. 4), since then this surface can exert an entrainment action by friction upon the sliver. The path of the sliver duct 8 as shown in FIGS. 1 to 4 however is not the only path which the fiber sliver duct 8 can assume in a turntable 3 equipped with radially offset calender rolls 11 and 12. In principle, any path of the fiber sliver duct can be chosen within the scope of the present invention, in which the sliver duct, as viewed in top plan, merges approximately tangentially into the circle described by the nip of the calender rolls 11 and 12.

FIGS. 3 and 4 furthermore illustrate the manner in which the fiber sliver, here identified by reference character 24, upon passing through the nip line formed by the calender rolls 11 and 12 is deposited substantially tangentially. Owing to the inventive arrangement of the rotational axes b and c of the calender rolls 11 and 12, the fiber sliver 24 is thus deposited without any deflection in its emerging movement direction, in a manner such that there is also insured even at the highest speeds an extremely careful deposition of the fiber sliver 24.

FIGS. 3 and 4 further show the provision of local recesses 25 and 26 provided in the turntable 3 for the calender rolls 11 and 12 as well as for the fiber sliver duct 8 and the lever 15. At its front portion the fiber sliver duct 8 is of substantially tubular shape.

The modified embodiment shown in FIGS. 3 and 4 differs from that shown in FIGS. 1 and 2 also by virtue of the fact that here the effect of the centrifugal force is eliminated. To achieve this, as shown in FIG. 4, the hub 27 of the lever 15, which forms the bearing for the pivotal movement about the shaft 28 forming the pivot axis d, is rigidly connected with a second lever 29. This second lever 29 is provided at its free end with a suitable countermass e.g., in the form of a round or circular body 30. The position of the center of gravity and the mass of the assembly of lever 29 and body 30 are chosen such that as the turntable 3 rotates the torque or moment of rotation generated by the mass of the lever 15 including the roll 12 is compensated by the opposite rotational moment or torque generated by the mass of the lever 29 and the body 30. In this way the influence of the centrifugal force is rendered ineffectual in comparison to the embodiment described with reference to FIGS. 1 and 2, in which arrangement such force is applied in order to generate the nip action between the calender rolls 11 and 12.

Since however a clamping or nip action force is required for transporting the fiber sliver between the calender rolls 11 and 12, this force, in the arrangement under discussion, is generated by a force accumulator acting upon the calender roll 12 in such a manner that the calender roll 12 is pressed against the calender roll 11. The force accumulator or force accumulator means comprises a torsion spring 31 or equivalent structure clamped at the shaft or axis 28 and exerting a rotational moment upon the lever 15 in the clockwise direction.

The embodiment described with reference to FIGS. 3 and 4 possesses a further advantage over the arrangement shown in FIGS. 1 and 2 in that the clamping force at the nip between the calender rolls 11 and 12 is independent of the rotational speed of the turntable 3. This can be of particular importance during the start-up and slow-down phases. Furthermore, the clamping force can be adapted to the prevailing requirements by suitably choosing the force exerted by the force accumulator 31.

It is also possible to consider utilizing combinational arrangements in which the influence of the centrifugal force is not completely eliminated by the offsetting mass, but wherein the centrifugal force also cooperates with the force exerted by the force accumulator.

Figure 5:
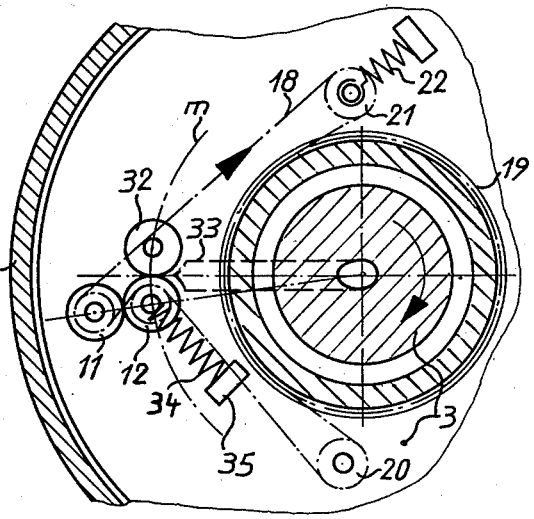
FIG. 5 is a purely schematic view of a further embodiment of inventive turntable.

In the exemplary embodiment according to FIG. 5 a substantially parallel deflection or deflecting roll 32 is operatively associated with the calender rolls 11 and 12 in such a manner that the rotational axes of one of the calender rolls, namely that of the calender roll 12 and of the deflecting roll 32 are arranged on a circular line m. Furthermore, the rotational axes of the calender rolls 11 and 12 and the rotational axis of the turntable 3, also in this arrangement, are disposed substantially in a single plane, i.e., the calender rolls 11 and 12 also are arranged adjacent one another in radial offset relationship.

Due to this arrangement there is attained a linear course or path of the fiber sliver duct 33, as seen in top plan view, while the required deflection of the fiber sliver from the radial to the tangential direction is effected by the group of rolls 11, 12 and 32. The fiber sliver is deflected by the surface of the calender roll 12 between a first nip line formed by the rolls 12 and 32 and a second nip line formed by the rolls 11 and 12. This arrangement affords the advantage, in comparison with the arrangement described with reference to FIGS. 1 and 2, that no friction can be generated in the fiber sliver duct 33 due to fiber sliver deflection.

Additionally, the outer calender roll 11 and the deflecting roll 32 are advantageously arranged so that they are supported stationarily in the turntable 3, whereas the inner calender roll 12, acting as a pressure roll, is pressed against the outer calender roll 11 and against the deflection roll 32. In order to generate the contact pressure of the calender roll 12, there is advantageously employed in this arrangement a force accumulator which acts upon the calender roll in a suitable direction e.g., at right angles with respect to the plane (not shown) containing the rotational axes of the rolls 11 and 32, such as for instance a pressure spring 34 which is tensioned between the roll 12 and a stop 35.

The calender rolls 11 and 12 in this arrangement are driven in exactly the same manner as described with reference to the embodiment shown in FIGS. 1 and 2 previously considered. The deflection or deflecting roll 32, however, does not require any positive drive, rather can be rotated by being entrained by the calender roll 12. If desired, however, also the deflection roll 32 can be positively driven by the belt 18.

In summation it is here stated that the major advantages of the inventive turntable constructions are the following:

(a) Improved sliver deposition inasmuch as the fiber sliver already emerges from the calender rolls in tangential direction and therefore does not require any further deflection. As a result there can be achieved higher sliver deposition speeds without damage to the sliver.

(b) Owing to the parallel arrangement of the rolls with respect to the rotational axis of the turntable there is realized a simplified drive mechanism without angled gear arrangements and without gears of any type. Thus there are realized simpler and less noisy machines and reduced maintenance work.

(c) The required design height of the turntable is reduced as there is not needed any space for accommodating an angled gear train. The resulting advantage is realized either in terms of easier operation of the machine or in the application of higher sliver cans which can receive a greater quantity of fiber sliver material.

(d) There is realized a simple design which permits retrofitting into existing machines without any difficulties, into coiler arrangements operating with rotating sliver cans as well as coiler arrangements working with stationary sliver cans.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A turntable arrangement for depositing a moving fiber sliver into a sliver can, comprising:

a turntable having a rotational axis;

said turntable being provided with a sliver duct through which passes the fiber sliver;

calender rolls provided for the turntable;

said calender rolls, viewed in the direction of movement of the fiber sliver, being arranged after the sliver duct and rotating together with the sliver duct;

each calender roll having a rotational axis; and each calender roll being arranged such that its rotational axis extends substantially parallel to the rotational axis of the turntable;

said calender rolls define two calender rolls; and the rotational axes of the calender rolls and the rotational axis of the turntable are located at least substantially in one plane.

2. A turntable arrangement for depositing a moving fiber sliver into a sliver can, comprising:

a turntable having a rotational axis;

said turntable being provided with a sliver duct through which passes the fiber sliver;

calender rolls provided for the turntable;

said calender rolls, viewed in the direction of movement of the fiber sliver, being arranged after the sliver duct and rotating together with the sliver duct;

each calender roll having a rotational axis; and each calender roll being arranged such that its rotational axis extends substantially parallel to the rotational axis of the turntable;

the rotational axes of the calender rolls and the rotational axis of the turntable are located at least substantially in one plane;

said calender rolls constituting two calender rolls defining a first calender roll and a second calender roll;

said first calender roll being arranged more distant from the rotational axis of the turntable than the second calender roll;

means stationarily mounting said first calender roll with respect to the turntable;

said second calender roll cooperating with said first calender roll; and means for radially movably arranging said second calender roll and for enabling said second calender roll to be pressed against the first calender roll.

3. The turntable arrangement as defined in claim 2, wherein:

said second calender roll is pressed against the first calender roll by the action of centrifugal force.

4. The turntable arrangement as defined in claim 2, wherein:

said means radially movably arranging said second calender roll comprises a lever supported at the turntable;

said lever being pivotable about a pivot axis which extends substantially parallel to the rotational axis of the turntable.

5. The turntable arrangement as defined in claim 4, further including:

a mass provided for said lever;

said mass being arranged substantially symmetrically with respect to the mass of the second calender roll so that no rotational moment is exerted upon the lever due to the action of the centrifugal force.

6. The turntable arrangement as defined in claim 2, further including:

force accumulator means for pressing the second calender roll against the first calender roll.

7. The turntable arrangement as defined in claim 6, wherein:

said force accumulator means comprises a torsion spring.

8. A turntable arrangement for depositing a moving fiber sliver into a sliver can, comprising:

a turntable having a rotational axis;

said turntable being provided with a sliver duct through which passes the fiber sliver;

calender rolls provided for the turntable;

said calender rolls, viewed in the direction of movement of the fiber sliver, being arranged after the sliver duct and rotating together with the sliver duct;

each calender roll having a rotational axis; and each calender roll being arranged such that its rotational axis extends substantially parallel to the rotational axis of the turntable;

said calender rolls define two calender rolls;

a deflection roll arranged essentially parallel to said calender rolls;

the rotational axis of one of the calender rolls and the deflecting roll being arranged substantially at the same distance from the rotational axis of the turntable and the rotational axes of the calender rolls and the rotational axis of the turntable being arranged at least substantially in one plane.

9. The turntable arrangement as defined in claim 8, wherein:

said calender rolls define an outer calender roll and an inner calender roll;

said outer calender roll and the deflecting roll being arranged stationarily with respect to the turntable; and the inner calender roll being arranged such that it can be pressed against both the outer calender roll and the deflection roll.

10. The turntable arrangement as defined in claim 9, further including:

a common force accumulator for pressing the inner calender roll against the outer calender roll and against the deflection roll.

11. The turntable arrangement as defined in claim 10, wherein:

said common force accumulator comprises a compression spring.

12. A turntable arrangement for depositing a moving fiber sliver into a sliver can, comprising:

a turntable having a rotational axis;

said turntable being provided with a sliver duct through which passes the fiber sliver;

calender rolls provided for the turntable;

said calender rolls, viewed in the direction of movement of the fiber sliver, being arranged after the sliver duct and rotating together with the sliver duct;

each calender roll having a rotational axis; and each calender roll being arranged such that its rotational axis extends substantially parallel to the rotational axis of the turntable;

a support member for rotatably supporting the turntable;

said support member being provided with a belt pulley;

a belt provided for and cooperating with said belt pulley;

a belt pulley member provided for at least one of the calender rolls;

said belt driving the calender rolls and partially surrounding the belt pulley of the support member and said belt pulley member of said at least one calender roll.

13. The turntable arrangement as defined in claim 12, wherein:

said belt comprises a toothed belt.

* * * * *